US006682393B1

(12) United States Patent
Puett, III

(10) Patent No.: US 6,682,393 B1
(45) Date of Patent: Jan. 27, 2004

(54) NOISEMAKER

(76) Inventor: Ralph Thomas Puett, III, 2975 McDonald La., Corona, CA (US) 92881

( * ) Notice: Subject to any disclaimer, the term of this patent is extended or adjusted under 35 U.S.C. 154(b) by 0 days.

(21) Appl. No.: 10/191,239

(22) Filed: Jul. 9, 2002

(51) Int. Cl.[7] ..... A63H 5/00
(52) U.S. Cl. ..... 446/418; 446/419
(58) Field of Search ..... 446/10, 166, 167, 446/168, 297, 369, 397, 418, 419, 420, 421, 422; 84/402; D21/59, 406; 215/231

(56) References Cited

U.S. PATENT DOCUMENTS

| | | | | | |
|---|---|---|---|---|---|
| 4,075,922 | A | | 2/1978 | Smith | |
| 4,090,705 | A | | 5/1978 | Young | |
| 4,179,973 | A | * | 12/1979 | White | 84/402 |
| 4,454,204 | A | | 6/1984 | Posey | |
| 4,968,283 | A | * | 11/1990 | Montgomery | 446/419 |
| 5,323,678 | A | * | 6/1994 | Yould | 84/418 |
| 5,377,575 | A | | 1/1995 | Huth, III | |
| 5,483,859 | A | * | 1/1996 | Singer | 84/322 |
| 5,659,143 | A | * | 8/1997 | Isackson | 84/402 |
| 5,814,747 | A | | 9/1998 | Ramsell | |

* cited by examiner

*Primary Examiner*—Derris H. Banks
*Assistant Examiner*—Bena B. Miller

(57) ABSTRACT

The present invention is an improved noisemaker. In particular, it is a cylindrical noisemaker containing two sets of commingled particles having a predetermined tonality. The noisemaker comprises a cylinder containing a first set of particles. Each particle in the first set is preferably made of polypropylene and averages at least four millimeters in diameter. The first set of particles is commingled with a second set of particles in the cylinder. Each particle in the second set is preferably made of general purpose polystyrene and averages at least six millimeters in diameter. The cylinder is preferably made of high impact polystyrene of 1.5 millimeters thickness or less. The first set of particles preferably comprises 437 particles and the second set of particles preferably comprises 325 particles.

5 Claims, 1 Drawing Sheet

NOISEMAKER

TECHNICAL FIELD

The present invention is an improved noisemaker. In particular, it is a cylindrical noisemaker containing two sets of commingled particles.

BACKGROUND ART

Generally, various noisemakers are known including U.S. Pat. Nos. 4,075,922, 4,090,705, 4,179,973, 4,454,204, 5,377,575, and 5,814,747. Often, patrons at sporting events in various venues use assorted noisemaking devices to cheer on their teams. However, prior art noisemakers can have an undesired tonality or have various drawbacks to their use at today's sporting venues, e.g. player and patron security issues. Thus, a noisemaker having a predetermined tonality and that addresses, inter alia, player and patron security issues is desired.

SUMMARY OF THE INVENTION

The present invention is an improved noisemaker. In particular, it is a cylindrical noisemaker containing two sets of commingled particles having a predetermined tonality. The noisemaker comprises a cylinder containing a first set of particles. Each particle in the first set is preferably made of polypropylene and averages at least four millimeters in diameter. The first set of particles is commingled with a second set of particles in the cylinder. Each particle in the second set is preferably made of general purpose polystyrene and averages at least six millimeters in diameter. The cylinder is preferably made of high impact polystyrene of 1.5 millimeters thickness or less. The first set of particles preferably comprises 437 particles and the second set of particles preferably comprises 325 particles.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved noisemaker.

Figure 1:
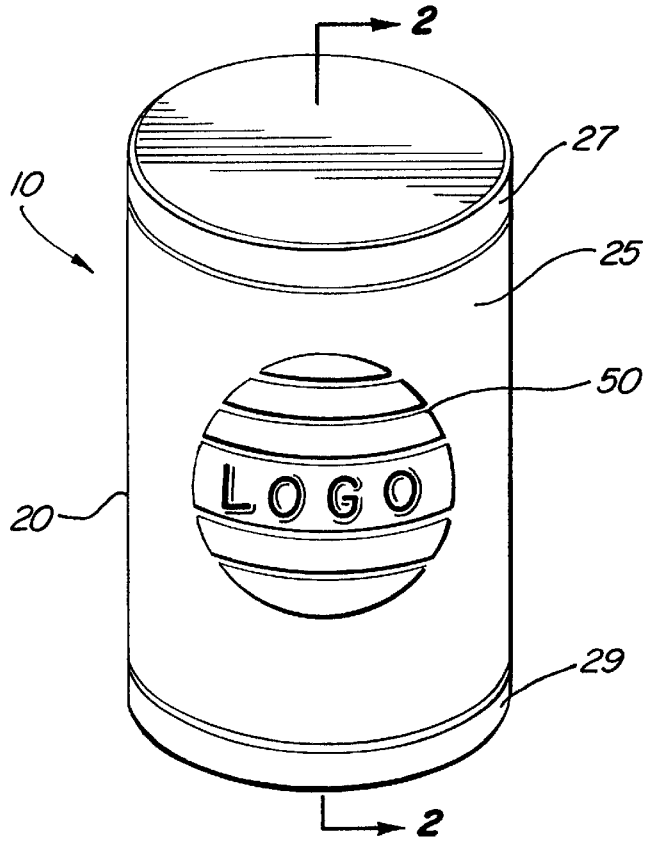
FIG. 1 is a front view of a preferred embodiment of the invention.

Referring now to FIG. 1, a preferred embodiment of the invention 10 is shown. An improved noisemaker 10 preferably comprises a cylinder 20. The cylinder 20 is preferably made of high impact polystyrene of 1.5 millimeters thickness. This relatively thin and light material provides for a safer item for use in sporting venues where unruly patrons may hurl the cylinder 20 at, inter alia, players or other patrons. The cylinder 20 is more likely to buckle and/or collapse when it impacts another solid object such as a person. Thus, it is less likely to injure a person than if a more rigid object struck the person. The use of high impact polystyrene of a predetermined thickness for the cylinder 20 also assists in creating a predetermined tonality sought by the user.

The cylinder has an exterior surface 25 that, preferably, bears a mark 50 such as a sports team's trademark, service mark and/or logo. Alternately, the mark 50 could be a picture, photograph and/or other design. The cylinder 20 preferably has a stripe 27 molded around the top of the cylinder 21 and a stripe 29 around the bottom of the cylinder 22. These stripes 27, 29 can be used as painting guides during manufacture of the product. A patron at a sporting event can root for his or her favorite team by using the improved noisemaker 10 bearing the logo 50 for his or her favorite team.

Figure 2:
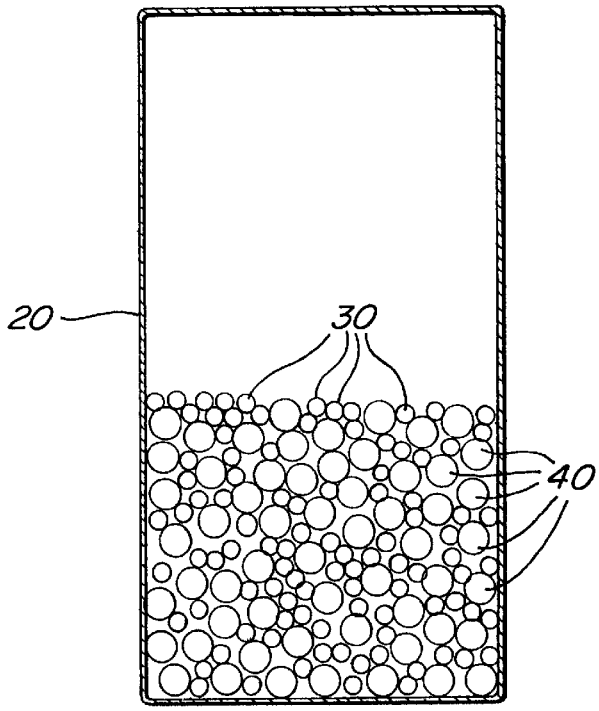
FIG. 2 is a cross-sectional view of a preferred embodiment of the invention.

Referring to FIG. 2, the cylinder 20 preferably contains at least two sets of commingled particles 30 and 40. The first set of particles has 387 to 487 particles in the first set. The preferred count for the first set of particles is 437 particles. The second set of particles has 275 to 375 particles in the second set. The preferred count for the second set of particles is 325 particles. Each particle in the first and second sets 30, 40 are preferably bead shaped. In the preferred embodiment of the invention, each particle in the first set of particles is smaller than each particle in the second set of particles. Preferably, the first set of particles 30 comprises polypropylene and each particle in the set averages at least four millimeters in diameter. The second set of particles 40 preferably comprises general purpose polystyrene and each particle in the set averages at least 6 millimeters in diameter, preferably 6.2 millimeters in diameter. Controlling the number, size and material of the particles commingled in the first and second sets 30 and 40 can generate a predetermined tonality in the cylinder 20.

Thus, an improved noisemaker is described above that has a predetermined tonality and addresses security issues at sporting venues. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A noisemaker comprising:

a cylinder of high impact polystyrene with a wall and end thickness of 1.5 millimeters or less;

a first set of particles located in the cylinder, each particle in the first set made of polypropylene and averaging at least four millimeters in diameter; and a second set of particles commingled with the first set of particles in the cylinder, each particle in the second set made of polystyrene and averaging at least six millimeters in diameter.

2. The noisemaker of claim 1 wherein the number of first set particles comprises 387 to 487 particles and the number of second set particles comprises 275 to 375 particles.

3. The noisemaker of claim 1 wherein the average diameter of the second set of particles is 6.2 millimeters.

4. The noisemaker of claim 1 wherein the number of particles in the first set is 437 particles and the number of particles in the second set is 325 particles.

5. The noisemaker of claim 1 wherein each of the particles is bead shaped.

* * * * *